US009827572B2

(12) United States Patent
Baker

(10) Patent No.: US 9,827,572 B2
(45) Date of Patent: Nov. 28, 2017

(54) PIPELINE MAGNETIC SEPARATORS, MORE PARTICULARLY TO PIPELINES ALONG WHICH MATERIAL IS CONVEYED

(71) Applicants: Active Magnetics Research Pty. Ltd., Unanderra, NSW (AU); William John Baker, Figtree, NSW (AU); Gwenneth Merle Baker, Figtree, NSW (AU); WJB Nominees Pty. Ltd., Unanderra, NSW (AU)

(72) Inventor: William John Baker, Unanderra (AU)

(73) Assignees: Active Magnetics Research Pty. Ltd., Unanderra, NSW (AU); WJB Nominees Pty. Ltd., Unanderra, NSW (AU); William John Baker, Figtree, NSW (AU); Gwenneth Marie Baker, Figtree, NSW (AU)

( * ) Notice: Subject to any disclaimer, the term of this patent is extended or adjusted under 35 U.S.C. 154(b) by 0 days.

(21) Appl. No.: 15/053,741

(22) Filed: Feb. 25, 2016

(65) Prior Publication Data

US 2016/0279645 A1 Sep. 29, 2016

(30) Foreign Application Priority Data

Feb. 25, 2015 (AU) ..... 2015900664

(51) Int. Cl.

| | |
|---|---|
| ***B03C 1/00*** | (2006.01) |
| ***B03C 1/033*** | (2006.01) |
| ***B03C 1/28*** | (2006.01) |

(52) U.S. Cl.

CPC ..... *B03C 1/0332* (2013.01); *B03C 1/284* (2013.01); *B03C 1/286* (2013.01); *B03C 2201/18* (2013.01)

(58) Field of Classification Search

CPC ..... B03C 1/14; B03C 1/28; B03C 2201/00; B03C 2201/18

USPC ..... 209/215, 223.1

See application file for complete search history.

(56) References Cited

U.S. PATENT DOCUMENTS

| | | | | |
|---|---|---|---|---|
| 2,798,611 A * | 7/1957 | Prevost | B03C 1/28 | 210/222 |
| 5,593,378 A * | 1/1997 | Dyck | B04B 1/00 | 210/223 |
| 8,628,668 B2 * | 1/2014 | Simonson | B03C 1/0332 | 209/229 |

* cited by examiner

*Primary Examiner* — Terrell Matthews

(74) *Attorney, Agent, or Firm* — Barnes & Thornburg LLP

(57) ABSTRACT

A pipeline magnetic separator (10) having a magnet 20 including a length (24) that is to extend transverse of the separator chamber (19) to collect metal from flow passing in the direction (13) through the separator (10). The end surface (26) of the magnet (20) is hemispherical and is transverse of a longitudinal axis (33) of the magnet (20). Upstream of the magnet (20) is a flow diverter (25, 29).

29 Claims, 2 Drawing Sheets

PIPELINE MAGNETIC SEPARATORS, MORE PARTICULARLY TO PIPELINES ALONG WHICH MATERIAL IS CONVEYED

CROSS-REFERENCE TO RELATED APPLICATION

The present application claims priority to Australian Provisional Patent Application Serial No. 2015900664, filed on Feb. 25, 2015, the entirety of which is incorporated herein by reference.

FIELD

The present invention relates to magnetic separators through which product flows with the separator adapted to move metal from the flow.

BACKGROUND

In manufacture of food powders and liquids, such as dairy powders, dairy liquids, soups and sauces, magnetic metal particles must be removed prior to metal detectors in order to provide metal fragment free final products.

Such materials are conveyed by pneumatic or vacuum lines or in pipelines of liquid pumped under pressure to a location at which the final products is packaged.

A problem with current devices is the difficulty in magnetically extracting magnetic contamination without causing other material flow problems.

A variety of devices are available to remove contaminants from a flowable substance. As a particular example, magnetic devices are employed to remove magnetic material from material passing along a predetermined path through, over or under the magnetic device. Magnets within the device attract the magnetic material and remove it from the material flow. The magnets are then subsequently cleaned.

The above devices are often in the form of fixed bars across a material flow with the consequent that it is difficult to prevent blockage when there is particulate in the product. Further such bars are subject to localised abrasion where product strikes the fixed bars. Impact of product on bars or probes can cause product damage, blockage or adversely affect bulk density of packaged powder products.

Spherical magnets are also used in pipelines handling grain products and powders. These devices require a nose cone to achieve separation efficiency by reducing resistance to flow and product impingement. Where product is abrasive, a replaceable cap is used to protect the portion of the sphere around the nose cone. This may enable localised wear areas to be renewed but provides a crevice trap for contamination and moisture under the replaceable cap which is unacceptable in sensitive, hygienic circumstances.

When bolts have been used to hold down an aerodynamically designed nosing to a sphere or bar, removing and replacing bolts has proved impracticable. A totally welded on device (where possible due to magnetic field) solves the hygiene problem, but where abrasive wear occurs, the whole magnet has to be replaced.

OBJECT

It is the object of the present invention to overcome or substantially ameliorate at least one of the discussed problems.

SUMMARY OF INVENTION

There is disclosed herein a pipeline magnetic separator to remove metal from a flow of product passing through the separator, the separator including:

an inlet to receive the flow;

a separator chamber member providing a chamber communicating with the inlet so as to receive the flow;

an outlet communicating with the chamber via which product leaves the chamber; and a magnet mounted on the chamber member so as to extend across the chamber and therefore to extend across flow passing through the chamber, the magnet having a length extending across the chamber and an end extremity, the length having a longitudinal axis; and a flow diverter upstream of the magnet to divert flow relative to the magnet.

Preferably, the surface is transverse of said axis.

Preferably, the surface is arcuate.

Preferably, the surface is hemispherical.

Preferably, said chamber has a longitudinal central axis passing from the inlet to the outlet through said chamber, with the member includes a mounting portion spaced laterally from the chamber axis to which the magnet is attached so as to be secured to the member.

Preferably, said mounting portion includes a flange facing laterally outwardly away from said chamber, and said magnet includes a mounting flange, attached to the member mounting flange so as to close the chamber.

Preferably, the mounting flanges are releasably attached to provide for removal of the magnet.

Preferably, said flow diverter is fixed to the magnet, the diverter providing a ridge extending longitudinally of said length and facing said flow to aid in directing flow about the magnet.

Preferably, the flow diverter is welded to the magnet.

In an alternative preferred form, the flow diversion is located upstream of the magnet so as to be spaced therefrom to engage the flow to aid in directing the flow relative to the magnet.

Preferably, said flow diverter has passages and/or recesses that are aligned with major poles of the magnet.

BRIEF DESCRIPTION OF DRAWINGS

Preferred forms of the present invention will now be described by way of example with reference to the accompanying drawings wherein.

DESCRIPTION OF EMBODIMENTS

Figure 1:
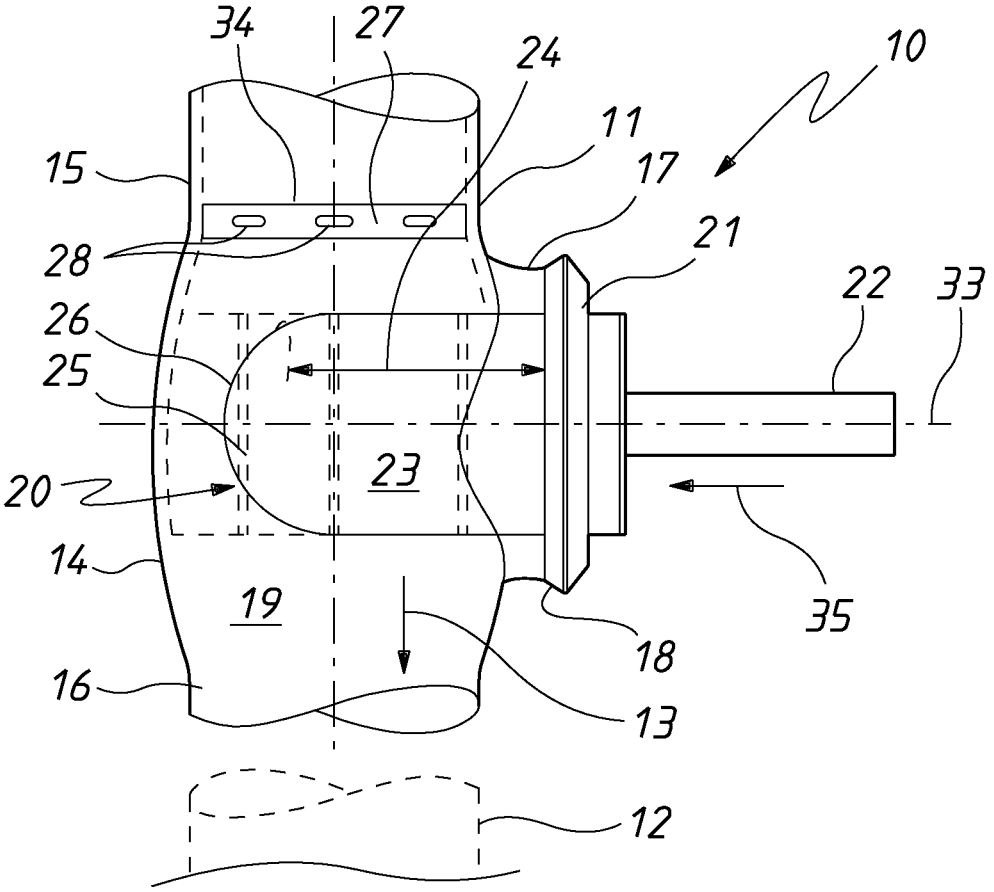
FIG. 1 is a schematic side elevation of a pipeline magnetic separator.
Figure 2:
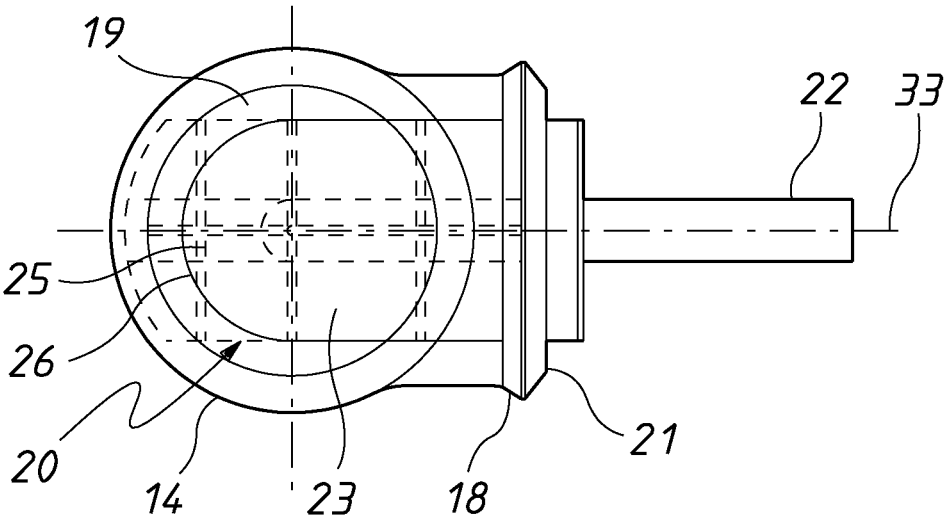
FIG. 2 is a schematic top plan view of the separator of FIG. 1.

In FIGS. 1 and 2 of the accompanying drawings there is schematically depicted a magnetic separator 10. The separator 10 is intended to be attached to an inlet pipe 11 and an outlet pipe 12 between which product flows in the direction 13. Preferably the direction 13 is generally downward.

The separator 10 includes a chamber providing member 14 having a bulbous configuration, an inlet 15 attached to the pipe 11, and an outlet 16 attached to the pipe 12. Preferably the connections between the inlet 15 and outlet 16 and the pipes 11 and 12 is a weld connection.

The member 14 has a lateral projection 17 providing a mounting flange 18. The flange 18 surrounds a laterally facing aperture.

The member 14 provides a chamber 19 into which projects a magnet 20. The magnet 20 has a mounting flange 21 fixed to the flange 18 so that the magnet 20 projects laterally across the flow passing through the chamber 19. The magnet 20 includes a shaft 22 that provides for gripping of the magnet 20 for the purposes of removal and cleaning. The flanges 18 and 21 are preferably connected via a gasket so that the chamber 19 is sealingly closed, and are preferably connected by threaded fasteners. The magnet 20 is moved through the above described laterally facing aperture.

Preferably, the magnet 20 includes a magnet body 23 fixed to the shaft 22. The flange 21 is preferably fixed to the body 23 via welding.

The magnet body 23 includes a length 24 that is of a rod configuration, and is preferably cylindrical (circular in transverse cross-section). The body 23 also has an extremity 25 that has an arcuate external surface 26. Preferably the surface 26 is hemispherical, having a radius corresponding to the radius of the length 24. Preferably, the surface is transverse of the longitudinal axis 33 of the body 23.

In respect of the above separator 10, it should be appreciated that flow passes over the length 24, as well as the end surface 26.

In one preferred form, the separator 10 includes a flow diverter 27 adjacent the inlet 15, that aids in directing flow about the magnet 20. In one preferred form, the flow diverter 27 is triangular in transverse cross-section so as to have an apex ridge 34 facing opposite the direction 13. In a further preferred form, surfaces of the flow director 27 that engage the flow are provided with dimples or other irregularities 28. In one preferred form the irregularities 28 are dimples that are aligned with the major poles of the magnet 20.

Figure 3:
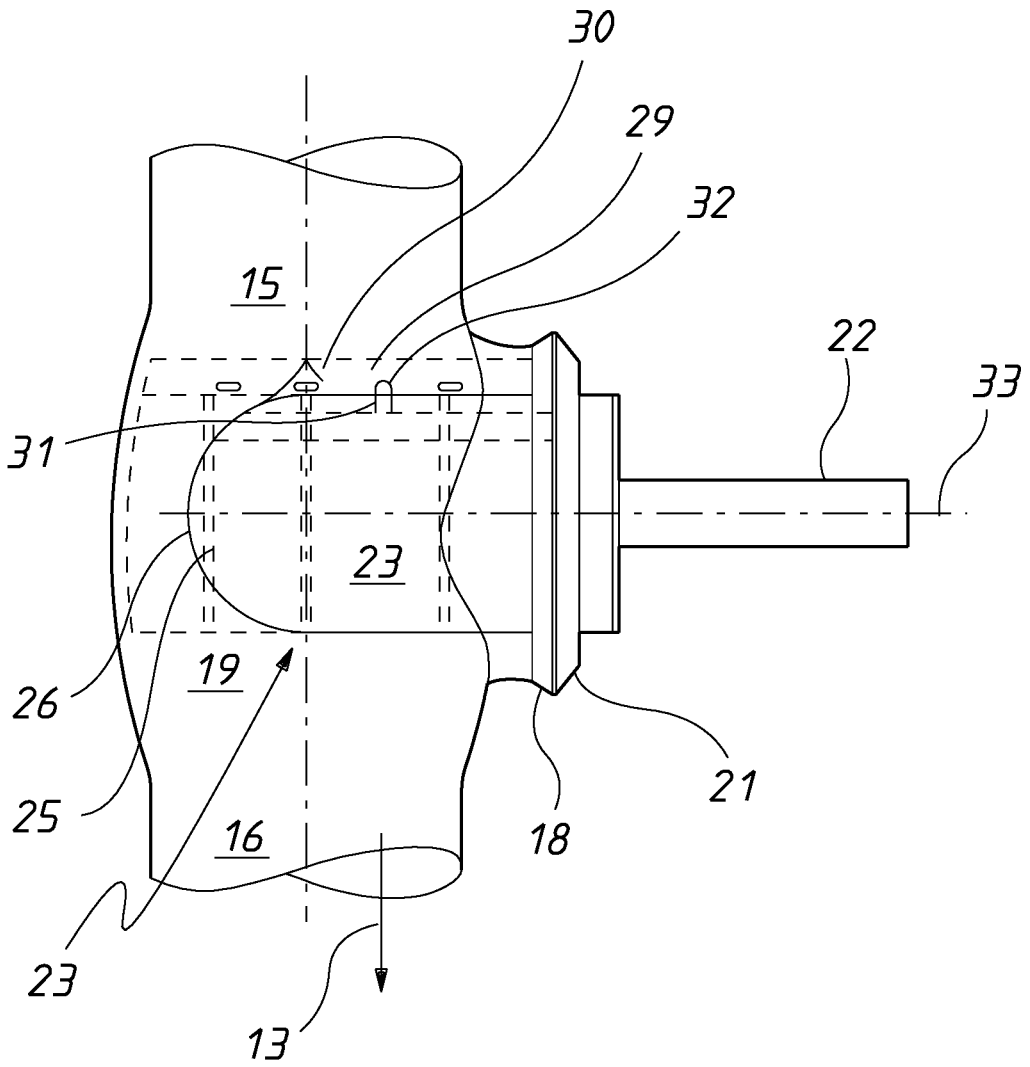
FIG. 3 is a schematic side elevation of a modification of the separator of FIGS. 1 and 2.

In a further preferred form (as shown in FIG. 3) the body 23 has attached to it a flow diverter 29. Preferably the flow diverter 29 has surfaces which converge upstream, that is a direction opposite direction 13. Most preferably the flow diverter is triangular in transverse cross-section so as to have a ridge apex 30.

The flow diverter 29 may be welded to the body 23, preferably seamlessly welded. In an alternative preferred form, the body 23 is provided with a projection 31 that is received within a corresponding recess 32 in the flow diverter 29 to position the flow diverter 29 correctly on the body 23. In this embodiment the flow diverter 29 would be magnetically attracted to the body 23 to retain it in position.

The magnet 20 is cleaned upon removal from the chamber 19 in the direction 35. The direction 35 is generally parallel to the axis 33. The magnet 20 is inserted in the direction 35.

The flow diverters 27 and 29 extend longitudinally the length of the length 24. The flow diverter 27 extends across at least the majority of the inlet 15, and preferably the entire width of the inlet 15.

The above described preferred embodiments have a number of advantages including meeting stringent dairy product hygiene regulations while providing a separator that reduces resistance to flow through the separator 10. A further advantage is reduction of wear, and the ease of replacement of worn components.

The invention claimed is:

1. A pipeline magnetic separator to remove metal from a flow of product passing through the separator in a generally downward direction, the separator including:

an inlet to receive the flow;

a separator chamber member providing a chamber communicating with the inlet so as to receive the flow, with the flow moving through the chamber in said direction;

an outlet communicating with the chamber via which product leaves the chamber; and a magnet mounted on the chamber member so as to extend across the chamber and therefore to extend across flow passing through the chamber, the magnet having a length extending across the flow inside the chamber and an end extremity, the length having a longitudinal axis, and said length having an end surface transverse of said axis, with flow passing over said surface in said direction; and a flow diverter upstream of the magnet to divert flow relative to the magnet, with the flow diverter extending laterally across said flow inside the chamber with the flow passing over the flow diverter in said direction.

2. The separator of claim 1, wherein the surface is arcuate.

3. The separator of claim 2, wherein the surface is hemispherical.

4. The separator of claim 1, wherein said chamber has a longitudinal central axis passing from the inlet to the outlet through said chamber, with the member including a mounting portion spaced laterally from the chamber axis to which the magnet is attached so as to be secured to the member.

5. The separator of claim 4, wherein said mounting portion includes a flange facing laterally outwardly away from said chamber, and said magnet includes a mounting flange attached to the member mounting flange so as to close the chamber.

6. The separator of claim 5, wherein the mounting flanges are releasably attached to provide for removal of the magnet.

7. The separator of claim 1, wherein said flow diverter is fixed to the magnet, the diverter providing a ridge extending longitudinally of said length and facing said flow to aid in directing flow about the magnet.

8. The separator of claim 7, wherein the flow diverter is welded to the magnet.

9. The separator of claim 1, wherein the flow diverter is located upstream of the magnet so as to be spaced therefrom to engage the flow to aid in directing the flow relative to the magnet.

10. The separator of claim 8, wherein said flow diverter has passages and/or recesses that are aligned with major poles of the magnet.

11. The separator of claim 1, wherein said chamber has a longitudinal central axis passing from the inlet to the outlet through said chamber, with the member including a mounting portion spaced laterally from the chamber axis to which the magnet is attached so as to be secured to the member.

12. The separator of claim 11, wherein said mounting portion includes a flange facing laterally outwardly away from said chamber, and said magnet includes a mounting flange attached to the member mounting flange so as to close the chamber.

13. The separator of claim 12, wherein the mounting flanges are releasably attached to provide for removal of the magnet.

14. The separator of claim 13, wherein said flow diverter is fixed to the magnet, the diverter providing a ridge extending longitudinally of said length and facing said flow to aid in directing flow about the magnet.

15. The separator of claim 14, wherein the flow diverter is welded to the magnet.

16. The separator of claim 15, wherein the flow diverter is located upstream of the magnet so as to be spaced therefrom to engage the flow to aid in directing the flow relative to the magnet.

17. The separator of claim 16, wherein said flow diverter has passages and/or recesses that are aligned with major poles of the magnet.

18. The separator of claim 1, wherein the magnet is an only magnet projecting into the chamber.

19. A pipeline magnetic separator to remove metal from a flow of product passing through the separator in a generally downward direction, the separator including:

a housing providing a separator chamber, an inlet and an outlet with the inlet receiving the flow, with the flow moving through the separator chamber in said direction to said outlet;

a magnet mounted on the housing so as to extend across the separator chamber and therefore to extend across the flow passing through the separator chamber, the magnet having a length extending across the flow inside the separator chamber and having a longitudinal axis transverse of said direction; and a flow diverter upstream of the magnet relative to said flow to divert the flow relative to the magnet, with the flow diverter extending laterally across said flow inside the chamber with the flow passing over the flow diverter in said direction to then pass the magnet, the flow diverter having surfaces that converge away from the magnet in a direction opposite said direction.

20. The separator of claim 19, wherein the flow diverter is formed separately from the magnet.

21. The separator of claim 19, wherein said flow diverter is fixed to the magnet.

22. The separator of claim 20, wherein the flow diverter is welded to the magnet.

23. The separator of claim 19, wherein the flow diverter is fixed relative to the magnet.

24. The separator of claim 19, wherein the flow diverter is located upstream of the magnet so as to be spaced therefrom to engage the flow to aid in directing the flow relative to the magnet.

25. The separator of claim 19, wherein said flow diverter has passages or recesses that are aligned with major poles of the magnet.

26. The separator of claim 19, wherein the separator is triangular in cross-section.

27. The separator of claim 19, wherein the surfaces extend to a ridge extending parallel to said longitudinal axis.

28. The separator of claim 19, wherein said predetermined direction is downward.

29. The separator of claim 19, wherein said longitudinal axis is horizontal.

* * * * *